US008896981B2

(12) United States Patent
Adachi et al.

(10) Patent No.: US 8,896,981 B2
(45) Date of Patent: Nov. 25, 2014

(54) RELAY DRIVE UNIT

(71) Applicant: DENSO CORPORATION, Kariya, Aichi-pref. (JP)

(72) Inventors: Ryo Adachi, Kiyosu (JP); Akito Itou, Kariya (JP); Katsumi Matsuo, Anjo (JP); Tsuneyoshi Isozaki, Nagoya (JP)

(73) Assignee: DENSO CORPORATION, Kariya (JP)

( * ) Notice: Subject to any disclaimer, the term of this patent is extended or adjusted under 35 U.S.C. 154(b) by 56 days.

(21) Appl. No.: 13/662,623

(22) Filed: Oct. 29, 2012

(65) Prior Publication Data

US 2013/0114178 A1 May 9, 2013

(30) Foreign Application Priority Data

Nov. 9, 2011 (JP) ..... 2011-245116

(51) Int. Cl.
*H01H 47/22* (2006.01)
*H01H 47/32* (2006.01)

(52) U.S. Cl.
CPC ..... *H01H 47/325* (2013.01)
USPC ..... 361/187

(58) Field of Classification Search
CPC ..... H02P 27/08; H01F 2007/1888; H01F 7/1844; H01F 2007/1894; H01F 7/18; H01H 47/22
USPC ..... 36/187; 361/187
See application file for complete search history.

(56) References Cited

U.S. PATENT DOCUMENTS

| | | | | |
|---|---|---|---|---|
| 6,661,635 | B1 | 12/2003 | Meid | |
| 8,110,939 | B2 * | 2/2012 | Itou | 307/10.6 |
| 8,410,740 | B2 * | 4/2013 | Suzuki | 318/490 |
| 2003/0036833 | A1 * | 2/2003 | Kobayashi | 701/36 |
| 2004/0120094 | A1 * | 6/2004 | Satoh | 361/160 |
| 2005/0047052 | A1 * | 3/2005 | Ueki et al. | 361/139 |
| 2006/0139839 | A1 | 6/2006 | Sato et al. | |
| 2008/0055799 | A1 * | 3/2008 | Serizawa et al. | 361/24 |

(Continued)

FOREIGN PATENT DOCUMENTS

| | | |
|---|---|---|
| JP | H02-077836 U | 6/1990 |
| JP | A-H6-260068 | 9/1994 |

(Continued)

OTHER PUBLICATIONS

Office action mailed Dec. 17, 2013 in the corresponding JP application No. 2011-245116 (with English translation).

(Continued)

*Primary Examiner* — Rexford Barnie
*Assistant Examiner* — Angela Brooks
(74) *Attorney, Agent, or Firm* — Posz Law Group, PLC

(57) ABSTRACT

A relay drive unit drives a relay by supplying a power source voltage from a battery. The relay drive unit includes a power source voltage detector, a drive signal generator, and a relay drive circuit. The power source voltage detector detects the power source voltage. The drive signal generator generates a PWM signal as a drive signal for maintaining the relay in an ON state. The PWM signal has a preset duty ratio according to a magnitude of the power source voltage detected by the power source voltage detector. The relay drive circuit turns a supply of the power source voltage from the battery on/off based on a duty ratio of the drive signal generated by the drive signal generator.

3 Claims, 4 Drawing Sheets

(56) References Cited

U.S. PATENT DOCUMENTS

| | | | | |
|---|---|---|---|---|
| 2009/0153117 | A1* | 6/2009 | Yabe et al. | 323/282 |
| 2010/0090526 | A1* | 4/2010 | Itou | 307/10.6 |
| 2011/0164340 | A1* | 7/2011 | Takeda | 361/25 |
| 2013/0114178 | A1* | 5/2013 | Adachi et al. | 361/187 |

FOREIGN PATENT DOCUMENTS

| | | | |
|---|---|---|---|
| JP | 09-233836 | A | 9/1997 |
| JP | A-2001-95138 | | 4/2001 |
| JP | A-2003-32919 | | 1/2003 |
| JP | 2004-095213 | A | 3/2004 |
| JP | A-2004-178967 | | 6/2004 |
| JP | 2008-060461 | A | 3/2008 |
| JP | A-2009-289690 | | 12/2009 |

OTHER PUBLICATIONS

Office action mailed Apr. 15, 2014 issued in the corresponding JP application No. 2011-245116 (and English translation).

* cited by examiner

FIG. 3

| POWER SOURCE VOLTAGE VB (V) | DUTY RATIO (%) OF PWM SIGNAL |
|---|---|
| 16 | 40.0 |
| 15.5 | 42.5 |
| 15 | 45.0 |
| 14.5 | 47.5 |
| 14 | 50.0 |
| 13.5 | 52.5 |
| 13 | 55.0 |
| 12.5 | 57.5 |
| 12 | 60.0 |
| 11.5 | 62.5 |
| 11 | 65.0 |
| 10.5 | 67.5 |
| 10 | 70.0 |
| 9.5 | 72.5 |
| 9 | 75.0 |
| 8.5 | 77.5 |
| 8 | 80.0 |
| < 8 | 100.0 |

RELAY DRIVE UNIT

CROSS REFERENCE TO RELATED APPLICATION

The present application is based on and claims the benefit of priority of Japanese Patent Application No. 2011-245116, filed on Nov. 9, 2011, the disclosure of which is incorporated herein by reference.

TECHNICAL FIELD

The present disclosure generally relates to a relay drive unit for driving a relay, especially for an in-vehicle electronic control unit.

BACKGROUND

Conventionally, a relay drive unit, as disclosed in, for example, Japanese Patent Laid-Open No. 2004-178967 (JP '967), is used for controlling a relay in an in-vehicle electronic control unit. The relay drive unit drives a relay to switch a power supply from a battery on/off for a motor drive unit. The relay drive unit may include a coil voltage detecting unit, a transistor, and a relay drive instruction unit. The coil voltage detecting unit detects a voltage between terminals of a relay coil as a coil voltage, and the transistor turns the power supply from the battery on/off. The relay drive instruction unit turns the transistor on/off by outputting a pulse width modulation signal (i.e., a PWM signal) to the transistor, where the transistor is turned on/off according to the coil voltage detected by the coil voltage detecting unit.

When the coil voltage changes according to the change of the battery voltage, the relay drive unit of JP '967 changes the duty ratio of the PWM signal according to the coil voltage detected. In such manner, an electric current flowing in the coil is kept stable at a constant value, and the relay is kept in the ON state.

Another example of a relay drive unit is disclosed in, for example, Japanese Patent Laid-Open No. 2006-185811 (JP '811). In this example, the relay drive unit includes an initial power on circuit, a constant voltage power circuit, and an electric current keep circuit. The initial power on circuit turns on the relay by supplying an initial electric current based on the battery voltage when an external switch is turned on. The constant voltage power circuit generates a constant voltage for keeping a relay contact in an ON state after the relay has transited to an ON state. The electric current keep circuit keeps the constant voltage being supplied for the relay by using the constant voltage as a power source. Per the relay drive of JP '811, the voltage of the relay coil is fed back to the constant voltage power circuit based on the monitoring of the voltage of the relay coil, and a constant voltage is output from the constant voltage power circuit based on such feedback, so that an electric current flowing in the relay is kept to a constant amount.

However, in the relay drive unit of JP '967, the circuit for detecting the inter-terminal voltage of the relay coil is separate from the relay drive circuit. Therefore, the production cost of the relay drive unit is increased. Further, in the relay drive unit of JP '811, the circuit for keeping the constant voltage of the relay coil is complex by using many parts, also leading to an increase of production cost.

SUMMARY

In an aspect of the present disclosure, a relay drive unit drives a relay based on a supply of a power source voltage from a power source. The relay drive unit includes a power source voltage detector, a drive signal generator, and a relay drive circuit. The power source voltage detector detects the power source voltage. The drive signal generator generates a PWM signal as a drive signal for maintaining the relay in an ON state. The drive signal has a preset duty ratio according to a magnitude of the power source voltage detected by the power source voltage detector. The relay drive circuit turns a supply of the power source voltage from the battery on/off based on a duty ratio of the drive signal generated by the drive signal generator.

Accordingly, the drive signal, which is a PWM signal, is generated according to the power source voltage supplied to the relay. Therefore, when the power source voltage changes, so does the drive signal in order to maintain the ON state of the relay. For instance, based on the duty ratio of the PWM signal, a supply of the power source voltage for the relay is switched on/off. In such manner, a stable operation of the relay is realized.

Further, by intermittently supplying the power source voltage from the power source to the relay, ON state of the relay is maintained. Therefore, the relay drive power of the present disclosure is less than that of a method that constantly supplies the power source voltage to the relay.

In addition, the drive signal generation unit outputs the PWM signal having a preset duty ratio that is set according to the detected power supply voltage. By pre-setting a duty ratio that can keep the ON state of the relay, the duty ratio calculation may not be required at the time of detection of the power source voltage.

The drive signal generator of the relay drive unit may generate a PWM signal having 100% duty ratio when the power source voltage detected decreases to a value smaller than a predetermined voltage. In such manner, the relay is maintained in the ON state. Therefore, by setting the predetermined voltage to an appropriate value, even when the detected power source voltage decreases below the predetermined voltage, which may cause a loss of the ON state of the relay, a continuous supply of the power source voltage for the relay is realized. In other words, the relay ON state is securely maintained.

The power source voltage detector of the relay drive unit may have a voltage-dividing circuit that outputs a voltage according to the power source voltage, and detects the power source voltage based on an output voltage from the voltage-dividing circuit.

Accordingly, the power source voltage detector detects the power supply voltage based on the voltage that is defined by the output power source voltage from a voltage-dividing circuit. For example, when the power source voltage is detected based on the voltage that is input to an AD input port of a microcomputer, a detection voltage detected at the AD port is usually equal to or below a microcomputer drive voltage. Therefore, when the power source voltage has a higher value than the microcomputer drive voltage, the power source voltage is dropped by using the voltage-dividing circuit for an appropriate detection. In such manner, the PWM signal based on the power source voltage is used to securely maintain the relay in the ON state.

BRIEF DESCRIPTION OF THE DRAWINGS

Other objects, features and advantages of the present disclosure will become more apparent from the following detailed description disposed with reference to the accompanying drawings, in which:

FIG. 3 is a table of a power source voltage and an associated duty ratio of a PWM signal.

DETAILED DESCRIPTION

Figure 1:
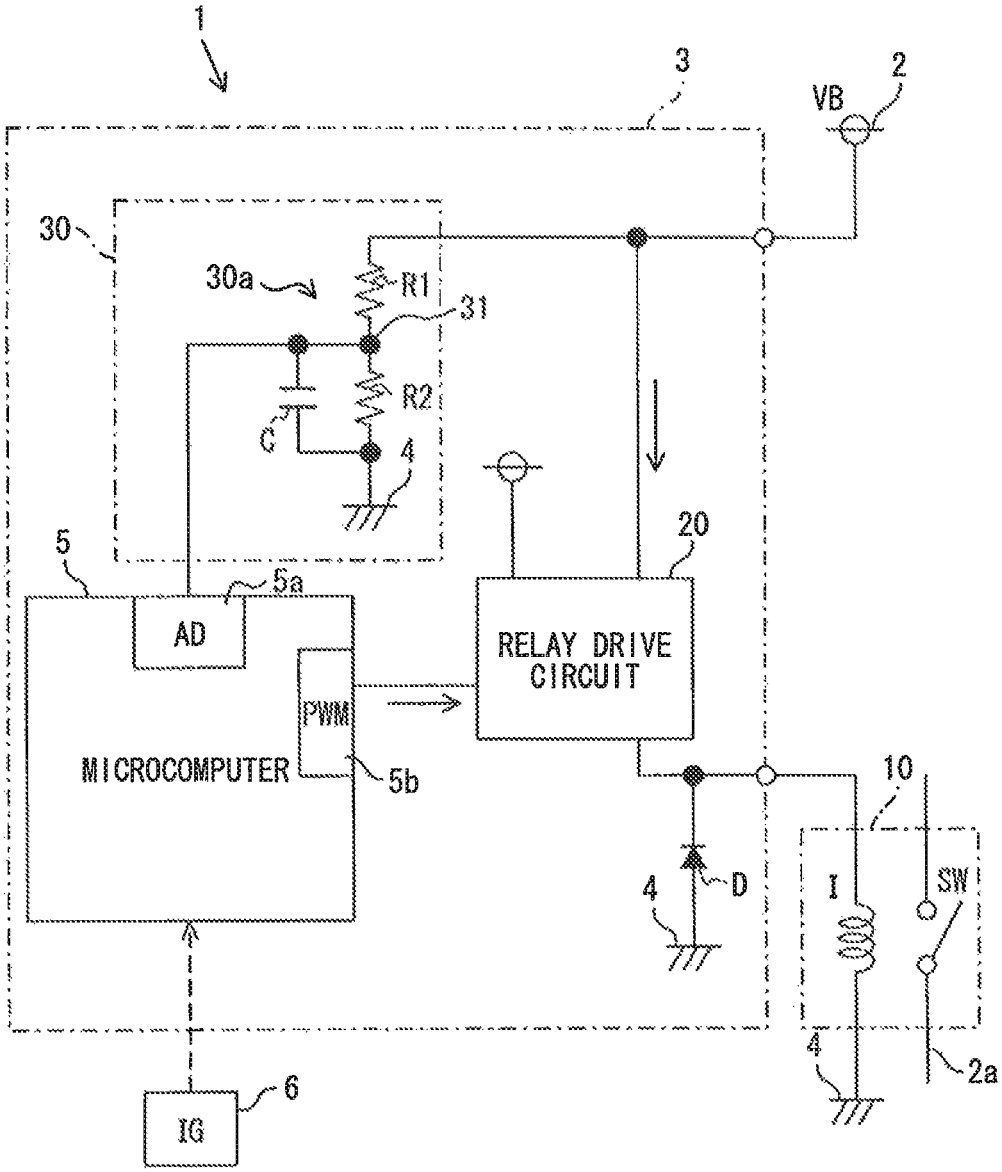
FIG. 1 is a circuit diagram of a relay drive unit and a relay driven by the relay drive unit of the present disclosure.

An embodiment of the present disclosure is described as follows with reference to the drawing. FIG. 1 shows a relay 10 driven by a relay drive unit 1. The relay drive unit 1 and the relay 10 are installed in a vehicle (not illustrated), and the relay 10 is disposed on a power supply line 2*a* that connects an electric load, such as an injector, to a battery (not illustrated) and switches on/off a power supply for the load from the battery.

The relay 10 has a relay coil I and a relay contact point SW. The relay coil I has one end connected to a ground (i.e., a reference voltage 4), and has the other end connected to a relay drive circuit 20. The relay 10 is turned on to supply the power from the battery to the electric load when an electric current is supplied to the relay coil I, thereby magnetizing the relay coil I and operating the relay contact point SW.

Conversely, the relay 10 is turned off to interrupt or turn off the power supply from the battery to the electric load, when the electric current is not supplied to the relay coil 1, thereby causing the relay contact point SW to remain open (i.e., turned off). Further, the relay coil I of the relay 10 is disposed in parallel with a diode D (i.e., a free wheel diode). The anode side of the diode D is connected to the reference voltage 4.

The relay drive unit 1 is installed in an electronic control unit 3, and includes the relay drive circuit 20, a voltage monitor circuit 30 (i.e., a power supply voltage detector in claims) and a microcomputer 5 (i.e., a power supply voltage detector and a drive signal generator in claims).

The relay drive circuit 20 has a switch element made of, for example, a transistor (not illustrated), and is connected to a power source 2 for supplying a power source voltage VB from the battery and to a terminal of the relay coil I. When the switch element of the relay drive circuit 20 is turned on, the power source voltage VB is supplied to the relay coil I, and the relay coil I is magnetized by an electric current that is in proportion to the value of the power source voltage VB flowing in the relay coil I. Thus, operating the relay contact point SW and turning on the power supply for the electric load. On the other hand, magnetization of the relay coil I is released when the switch element of the relay drive unit 20 is turned off, and the power supply for the electric load is interrupted.

The voltage monitor circuit 30 has a first resistor R1 and a second resistor R2, and may be referred to as resistors R1, R2 for brevity. The resistors R1, R2 are connected in series between the power source 2 and the reference voltage 4, such that the first resistor R1 is connected to the power source 2 and the second resistor R2 is connected to the reference voltage 4. The resistors R1, R2 form a voltage-dividing circuit 30*a* with a middle terminal 31 between the resistors R1, R2 connected to the microcomputer 5. Further a capacitor C is connected in parallel with the second resistor R2.

The power source voltage VB supplied from the power source 2 decreases according to resistance values of the resistors R1, R2, and a voltage that is lower than the power source voltage VB is provided to the microcomputer 5. Further, when a sudden change occurs to the power source voltage VB, a sudden change in the voltage provided to the microcomputer 5 is prevented by a charge to the capacitor C or a discharge from the capacitor C.

The microcomputer 5 is coupled to an ignition switch 6 that requests a start of relay drive. The ignition switch 6 outputs an output signal IG representing the on/off to the microcomputer 5.

The microcomputer 5 in the present embodiment serves as a power supply voltage detector and a drive signal generator, and has a CPU, a RAM, a ROM, and an input and output interface. The IG signal from the ignition switch 6 is A/D converted and rectified by the input interface, and then transmitted to CPU. The CPU performs various processes according to the control process stored in the ROM and the IG signal.

The microcomputer 5 has an AD port 5*a* to which a voltage from the voltage monitor circuit 30 is provided. The microcomputer determines the power source voltage VB based on a calculation that uses the voltage provided from the AD port 5*a* and resistance values of the resistors R1, R2. The power source voltage VB may be determined every, for example, 8 msec.

Further, the microcomputer 5 has a PWM signal output port 5*b*, and generates the PWM signal (i.e., a drive signal) having a duty ratio that is based on the power source voltage VB determined by the microcomputer 4. The microcomputer 5 outputs the PWM signal from the PWM signal output port 5*b* to the relay drive circuit 20, and the switch element of the relay drive circuit 20 is switched on/off based on the duty ratio of the PWM signal.

Figure 2:
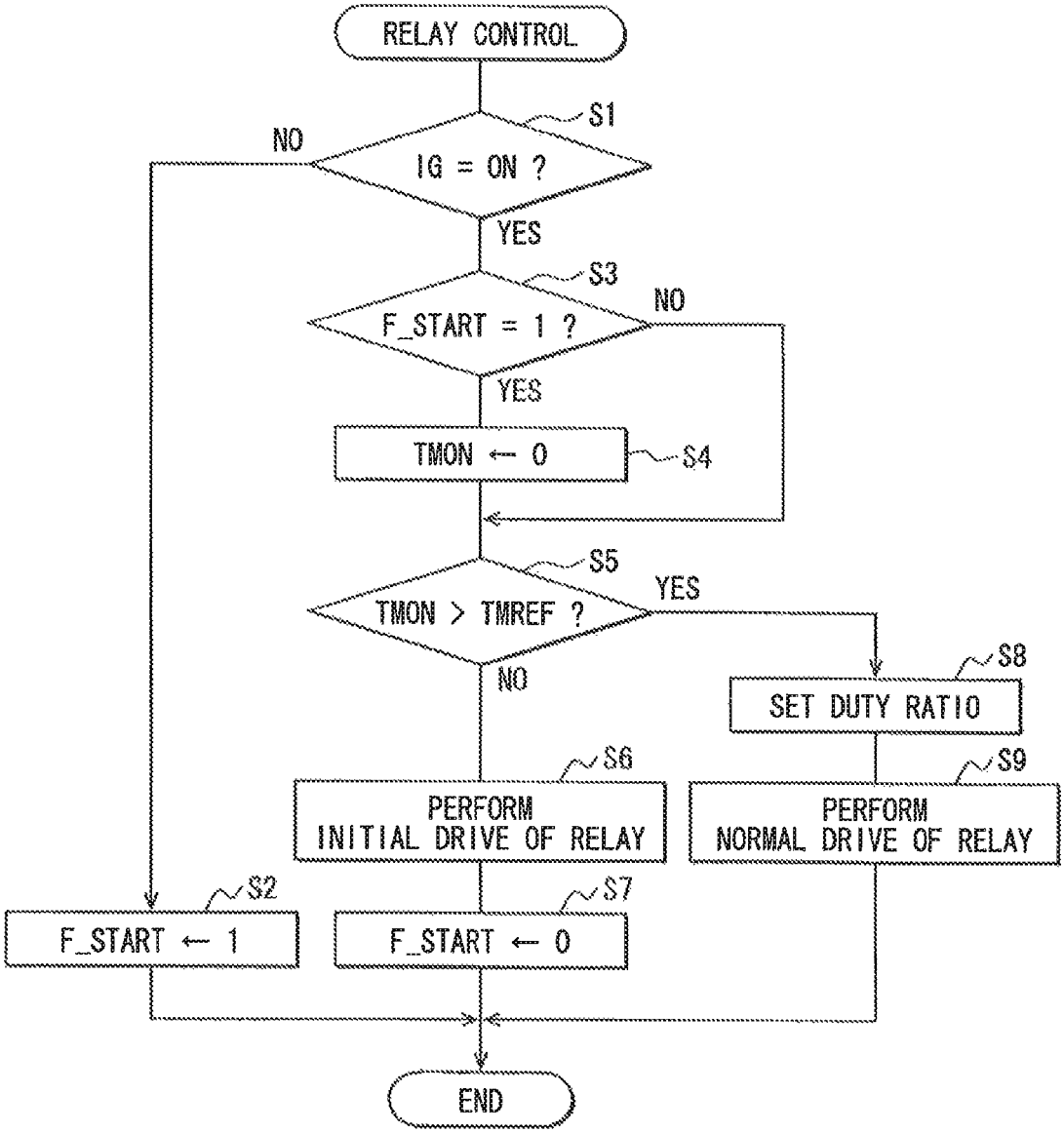
FIG. 2 is a flowchart of a relay control process.

With reference to FIG. 2, a control process of the relay 10 performed by the microcomputer 5 is described. This process is performed for keeping the ON state of the relay 10, which is realized by turning on/off of the supply of the power source voltage VB for the relay coil I based on the generation of the PWM signal having the duty ratio according to the power source voltage VB. Such process is repeated at predetermined intervals.

In S1, the microcomputer 5 determines whether the ignition switch 6 is turned on based on the signal IG. When the ignition switch 6 is off (S1:No) and there is no drive start request for operating/driving the relay, the microcomputer 5, in S2, sets a relay drive start flag F_START to "1", and finishes the process. The relay drive start flag F_START is set to "1" for driving the relay 10 and to start the power supply for the electric load.

On the other hand, when the ignition switch 6 is on (S1: Yes), the microcomputer 5, in S3, determines whether the relay drive start flag F_START is "1". In other words, the microcomputer 5 determines whether the power supply for the electric load should be turned on. If the power supply should be turned on (S3:Yes), the microcomputer 5 in S4 resets a timer value (TMON) of an initial drive timer to "0".

Subsequently, the microcomputer 5, in S5, determines whether the timer value TMON is greater than a predetermined time TMREF (e.g., 50 msec). The predetermined time TMREF is set to have a value that is longer than a required period of time between (i) a start of the supply of the power source voltage VB to the relay coil I and (ii) an ON timing of the relay 10 due to the operation of the relay contact point SW. The relays installed in a vehicle are usually turned on in 10 to 20 msec from the start of the voltage supply. Therefore, the predetermined time TMREF is set to have the value greater than such time period.

While the timer value TMON remains less than the predetermined time TMREF (S5:No), the microcomputer 5, in S6, generates a PWM signal having a duty ratio of 100% and outputs such signal to the relay drive circuit 20, thereby performing an initial drive of the relay. In such manner, the switch element of the relay drive circuit 20 is kept in an ON state, and the relay contact point SW is operated by the continuous supply of the power source voltage VB being supplied to the relay coil I.

Subsequently, the microcomputer 5 in S7 resets the relay drive start flag F_START (i.e., F_START=0), and the process is concluded. In such manner, a subsequent execution of the process, the determination for whether the relay drive start flag F_START is "1" remains no and the microcomputer 5 skips S4 for resetting of the timer value TMON, until the relay drive start flag F_START is set to "1" again in S2.

When the timer value TMON is greater than the predetermined time TMREF (S5: YES) the initial drive of the relay 10 has passed and the relay 10 is assumed to be turned on. The microcomputer 5, in S8, sets the duty ratio of the PWM signal based on the power source voltage VB and duty ratio of PWM signal table of FIG. 3. Per the table of FIG. 3, the lower the power source voltage VB, the higher the duty ratio value is set to, so that the amount of electric current flowing to the relay coil I is kept to a level that enables the ON state of the relay contact point SW. For instance, when the power source voltage VB is set to 16V, the duty ratio is set to 40%, and, for every 0.5V decrease of the power source voltage VB, the duty ratio is set to increase 0.25%.

Further, when the power source voltage VB becomes less than a predetermined voltage, the duty ratio is configured to become 100%. In the present embodiment, the predetermined voltage is set to 8V.

Subsequently, the PWM signal having the duty ratio set in S8 is generated and provided to the relay drive circuit 20, for performing a normal operation of the relay 10 in S9, and the present process is concluded.

In such manner, the switch element of the relay drive circuit 20 is switched on/off based on the duty ratio of the PWM signal, and the amount of electric current is determined based on the duty ratio of the PWM signal flows to the relay coil I.

According to FIG. 3, the lower the power source voltage VB, the higher the duty ratio is set. Therefore, even if the power source voltage VB decreases, the amount of electric current flowing in the relay coil I is approximately kept to a fixed value, thereby maintaining the ON state of the relay 10.

Figure 4:
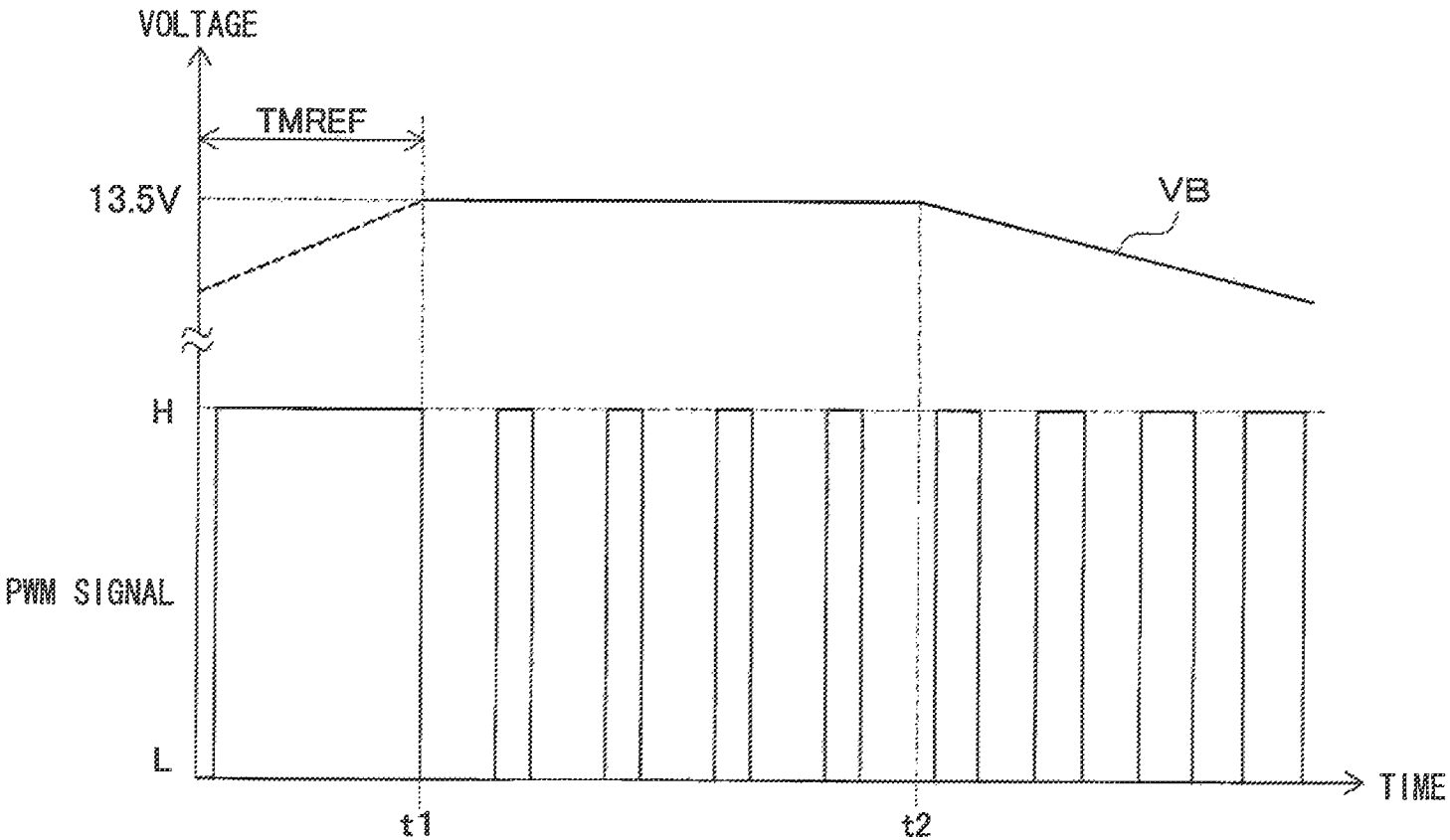
FIG. 4 is a timing chart describing an example of an operation of the relay drive unit of FIG. 1.

FIG. 4 is a timing chart illustrating an example of an operation of the relay drive unit 1 in the present embodiment. As shown in FIG. 4, immediately after the start of supply of electricity from the battery, the power source voltage VB supplied for the relay coil I is not stable, and increases slowly. Further, because a PWM signal of 100% duty ratio is generated and such signal is supplied for the relay drive circuit 20 in S6 of the relay control process, the power source voltage VB is continuously supplied to the relay coil I. The electric current based on the power source voltage VB flows in the relay coil I. Therefore, in such manner, the relay 10 is turned on, and the power supply from the battery to the electric load is enabled.

Further, when the power source voltage VB becomes stable at, for example, the value of 13.5V and the time from the start of the power source voltage VB exceeds the predetermined time TMREF at a timing t1, the duty ratio of the PWM signal is set based on the power source voltage VB detected in S8 and the PWM signal having such duty ratio is output to the relay drive circuit 20 thereafter.

When a decrease of the power source voltage VB is detected after a timing t2, the amount of electric current flowing in the relay coil I is kept unchanged by the switching of the duty ratio having a higher value based on the power source voltage VB, which is performed in S8. As a result, the ON state of the relay 10 is maintained.

Further, the ON state of the relay 10 is kept after the timing t2, by generating the PWM signal having even higher value when the power source voltage VB further decreases, or by setting the duty ratio of the PWM signal to have 100% value when the power source voltage VB decreases below the predetermined value.

Further, when the amount of the electric current flowing in the relay coil 11 regains (i.e., increases back to a certain level), the PWM signal is generated to have a lower duty ratio, for keeping the ON state of the relay 10 and for decreasing the amount of electric current flowing in the relay coil I.

As described above, according to the relay drive unit 1 of the present disclosure, the PWM signal provided to the relay drive circuit 20 is generated based on the power source voltage VB supplied for the relay coil I. Therefore, the ON state of the relay 10 is maintained, due to the change of the PWM signal that is based on the power source voltage VB even when the power source voltage VB changes. As a result, the drive of the relay 10 is stabilized.

Further, the drive of the relay 10 can be performed with reduced amount of power due to the turning on/off of the power source voltage VB for the relay coil I according to the duty ratio of the PWM signal, thereby enabling the continuation of the ON state of the relay 10 only by an intermittent supply of the power source voltage VB for the coil I.

Further, since the relay drive unit 1 of the present disclosure is installed in the electronic control unit 3 of a vehicle, a power source voltage monitor circuit/device for monitoring the power source voltage that is used by the vehicle, may also serve as a detector for detecting the power source voltage VB. Therefore, the advantageous effects are achieved without greatly increasing the production cost.

Further, for the same reason as state above, a pre-installed port for outputting the generated PWM signal can be utilized as the drive signal generator.

Based on the power source voltage VB detected, the PWM signal having the predetermined duty ratio is outputted, thereby saving the calculation of the duty ratio for every detection time of the power source voltage VB. Therefore, the stable drive of the relay 10 is enabled without suffering from the duty ratio calculation load.

Further, when the power source voltage VB detected decreases below the predetermined voltage thereby causing a possibility that the ON state of the relay 10 may not be kept, a PWM signal having 100% duty ratio is generated for a continuous supply of the power source voltage VB for the relay coil I, thereby securely enabling the ON state of the relay 10.

Further, a PWM signal of 100% duty ratio is generated from the start of the drive of the relay 10 to the predetermined time TMREF after the start of the supply of the power source voltage VB for the relay coil I. In other words, by waiting for a timing of secured ON state of the relay 10, the initial drive state transits to the normal drive state. Therefore, individual difference and/or the specification of the relay 10 will not affect the secured turning ON of itself.

Further, because the diode D is installed in parallel with the relay coil I, a surge current generated by the inductance of the relay coil I at a time of change of the electric current in the relay coil I, i.e., at a time of cutoff of the supply of the power source voltage VB for the relay coil I, can be release to a circuit having the diode D. Therefore, an influence of the surge current for the other circuit is prevented.

Further, because the microcomputer 5 detects the power source voltage VB based on the lower voltage that is decreased by the voltage-dividing circuit 30*a* to a level lower than the drive voltage of the microcomputer 5, the detection of the power source voltage VB is suitably performed. In such manner, the ON state of the relay 10 is securely kept by the PWM signal that is based on the power source voltage VB.

Though, in the above embodiment, the description is based on a normally-open type relay that switches the relay contact point SW from OFF to ON by the supply of the power source voltage VB for the relay coil I, the relay may be a normally-close type, which switches the relay contact point SW from ON to OFF by the supply of the power source voltage VB for the relay coil I.

In such case, the on/off timings of the supply of the power source voltage VB for the relay coil I based on a PWM signal are reversed from the example of the normally-open type timings.

Also, a microcomputer of an electronic control unit installed in a vehicle may have a port that generates and outputs the PWM signal. Therefore, if the relay drive unit of the present disclosure is installed in a vehicle, pre-provided PWM signal generation function in the vehicle can be utilized as the drive signal generator, thereby enabling the above effects without increasing the production cost.

Although the present disclosure has been fully described in connection with the preferred embodiment thereof with reference to the accompanying drawings, it is to be noted that various changes and modifications will become apparent to those skilled in the art, and such changes and modifications are to be understood as being within the scope of the present disclosure as defined by the appended claims.

What is claimed is:

1. A relay drive unit for driving a relay by supplying a power source voltage from a battery, the relay drive unit comprising:

a power source voltage detector detecting the power source voltage;

a drive signal generator generating a drive signal; and a relay drive circuit turning a supply of the power source voltage from the battery on or off based on a duty ratio of the drive signal generated by the drive signal generator, wherein the drive signal generator generates a PWM signal as the drive signal for maintaining the relay in an ON state, of which the drive signal having a preset duty ratio according to a magnitude of the power source voltage detected by the power source voltage detector, and the duty ratio of the drive signal is adjusted so that an electric power consumption amount is reduced according to a value of the power source voltage.

2. The relay drive unit of claim 1, wherein the drive signal generator generates the PWM signal having 100% duty ratio when the power source voltage detected by the power source voltage detector decreases to a value less than the predetermined voltage.

3. The relay drive unit of claim 1, wherein the power source voltage generator has a voltage-dividing circuit that outputs a voltage according to the power source voltage, and the power source voltage generator detects the power source voltage based on the voltage outputted from the voltage-dividing circuit.

* * * * *